US008041043B2

(12) United States Patent
Faller

(10) Patent No.: US 8,041,043 B2
(45) Date of Patent: Oct. 18, 2011

(54) PROCESSING MICROPHONE GENERATED SIGNALS TO GENERATE SURROUND SOUND

(75) Inventor: Christof Faller, Chavannes-près-Renens (CH)

(73) Assignee: Fraunhofer-Gesellschaft zur Foerderung Angewandten Forschung E.V., Munich (DE)

( * ) Notice: Subject to any disclaimer, the term of this patent is extended or adjusted under 35 U.S.C. 154(b) by 1315 days.

(21) Appl. No.: 11/652,615

(22) Filed: Jan. 12, 2007

(65) Prior Publication Data

US 2008/0170728 A1 Jul. 17, 2008

(51) Int. Cl.
*H04R 5/00* (2006.01)
*H04R 3/00* (2006.01)

(52) U.S. Cl. ..... 381/26; 381/92

(58) Field of Classification Search ..... 381/26, 381/92, 122

See application file for complete search history.

(56) References Cited

U.S. PATENT DOCUMENTS 7,274,794 B1 * 9/2007 Rasmussen ..... 381/92
2003/0139851 A1 * 7/2003 Nakadai et al. ..... 700/258

OTHER PUBLICATIONS

Hull, "Surround Sound Past, Present, and Future" Tech. Rep., Dolby Laboratories, 1999, www.dolby.com/tech.

Eargle, "Multichannel Stereo Matrix Systems: An Overview" IEEE Trans. on SPEECJ and Audio Proc., vol. 19, No. 7, pp. 552-559, Jul. 1971.

Dressler, "Dolby Surround Prologic II Decoder—Principles of Operation" Tech. Rep., Dolby Laboratories, 2000, www.dolby.com/tech/.

Gundry, "A New Active Matrix Decoder for Surround Sound" Proc. AES 19th Int. Conf., Jun. 2001.

* cited by examiner

*Primary Examiner* — Vivian Chin
*Assistant Examiner* — Kile Blair
(74) *Attorney, Agent, or Firm* — Harness, Dickey & Pierce, PLC

(57) ABSTRACT

Surround sound recording is a tedious task requiring the use of many microphones. The invention aims at enabling the use of two-channel microphones (or stereo microphones) for multi-channel surround recording. A conventional stereo microphone, or a two-channel microphone specifically optimized for use with the proposed algorithm, is used to generate two signals. A post-processor is applied to the microphone generated signals to convert them to multi-channel surround. This aim is achieved through a method to generate multiple output audio channels (y1, . . . , yM) from two microphone generated audio channels (x1, x2), in which the number of output channels is equal or higher than two, this method comprising the steps of:

determine directions of sound components related to the microphone characteristics determine compensation gains of sound components related to the microphone characteristics generating the output audio channels, y1, . . . , yM, by using the microphone generated audio channels, x1, x2, directions, and compensation gains.

20 Claims, 5 Drawing Sheets

PROCESSING MICROPHONE GENERATED SIGNALS TO GENERATE SURROUND SOUND

INTRODUCTION

The invention is related to recording of multi-channel surround audio signals. It enables surround sound recording using a two-channel microphone, or stereo microphone, by processing the microphone generated signals to generate a surround sound audio signal.

BACKGROUND ART

Surround sound is becoming widely used. Thus, the demand for convenient and cost effective recording of multi-channel surround sound is increasing. In the professional music recording domain, for example for recording of classical concerts, various techniques are being used for surround recording. When the goal is to capture the "natural spatial aspect" of a performance or concert, usually one microphone is used for each channel of the multi-channel surround audio signal. The main recording, obtained from a microphone associated with each surround channel, is often modified by using additional microphone signals, denoted spot or support microphones.

The currently used surround recording techniques are for various reasons not suitable for many applications, for example due to a requirement of small size of the microphone configuration and due to cost reasons. The Soundfield microphone manufactured by SoundField Ltd, UK, based on four nearly coincident microphones, fulfills the requirement of being relatively small. But it is a rather high-end microphone not suitable for low cost applications.

Many devices in the professional, semi-professional, and consumer domain are based on a capability to record and store a two-channel stereo signal. For example video cameras often provide only up to two audio channels which can be recorded. Some cameras provide up to four channels, but often at lower quality. Thus, even if a cost effective surround microphone would be available, it could often not be conveniently used due to the lack of devices to record and store surround audio signals.

BRIEF DESCRIPTION OF THE INVENTION

Surround sound recording is a tedious task requiring the use of many microphones. The invention enables the use of two-channel microphones (or stereo microphones) for multi-channel surround recording. A conventional stereo microphone, or a two-channel microphone specifically optimized for use with the proposed algorithm, is used to generate two signals. A post-processor is applied to the microphone generated signals to convert them to multi-channel surround.

This aim is achieved through a method to generate multiple output audio channels (y1, . . . , yM) from two microphone generated audio channels (x1, x2), in which the number of output channels is equal or higher than two, this method comprising the steps of:

- determine directions of sound components related to the microphone characteristics
- determine compensation gains of sound components related to the microphone characteristics
- generating the output audio channels, y1, . . . , yM, by using the microphone generated audio channels, x1, x2, directions, and compensation gains The microphone characteristics determine how level difference and phase cues are related the direction of arrival of sound at the microphones. Thus, the microphone characteristics, level difference cues, and possibly phase cues are used to determine the directions at which sound is rendered when generating the surround output signal channels. Further, as a function of microphone characteristics, sound at different directions have different gains which need to be compensated to achieve approximately the same gain within a desired range of directions. Thus, related to microphone characteristics and direction of sound, compensation gains are applied such that sound from each direction (within a desired range) will be present with the same gain in the surround output signal. Diffuse sound does not contain directional information and is thus treated differently, e.g. simultaneously mixed to several channels of the surround output signals, using reverberators and then mixed to the output signals, etc.

BRIEF DESCRIPTION OF THE DRAWINGS

The invention will be better understood thanks to the drawings in which.

Figure 2:
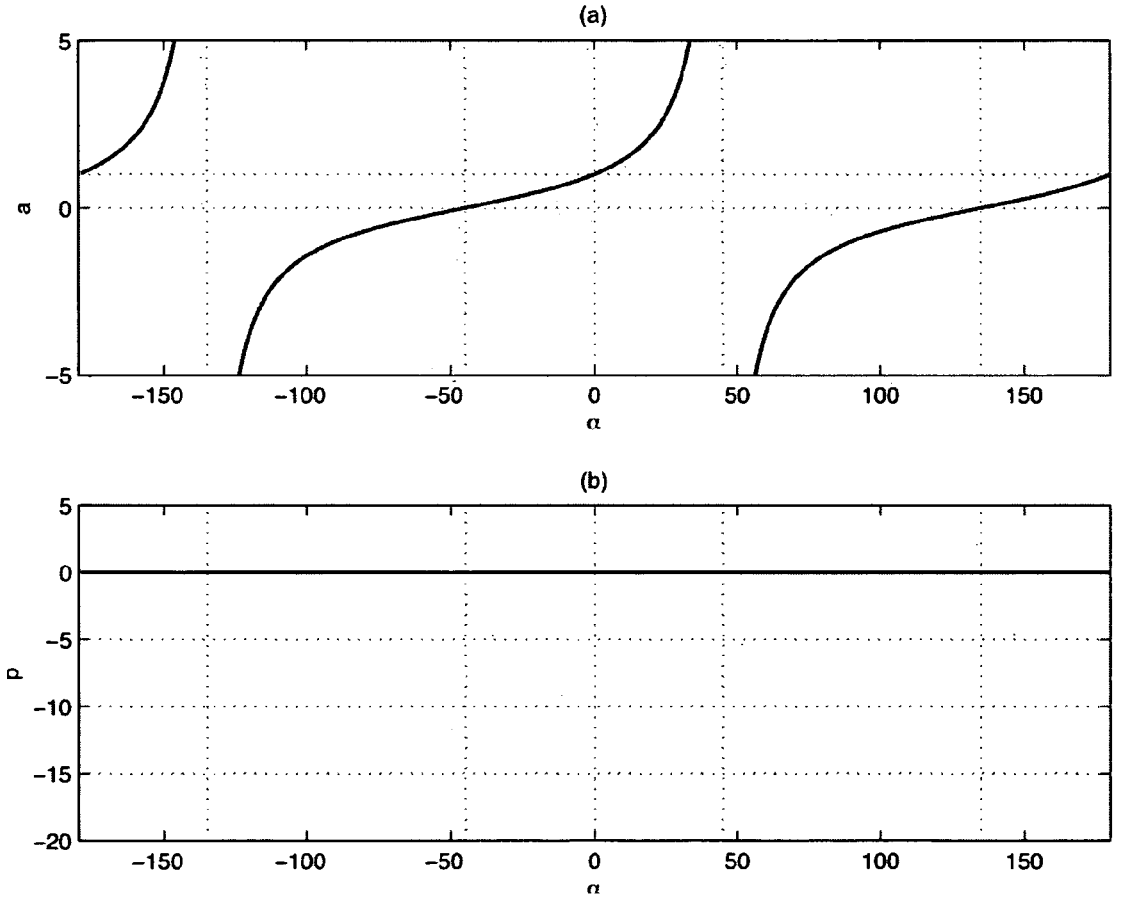

Part (a) of FIG. 2 shows the amplitude ratio as a function of direction of arrival of sound for two coincident dipole microphones and Part (b) shows the corresponding total response as a function of direction of arrival of sound.

Figure 3:
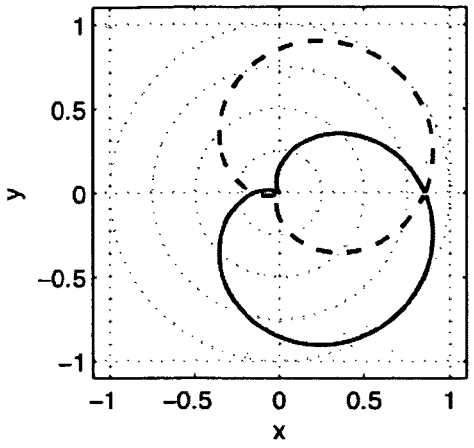

FIG. 3 shows the directional responses of two coincident cardioid microphones.

Figure 4:
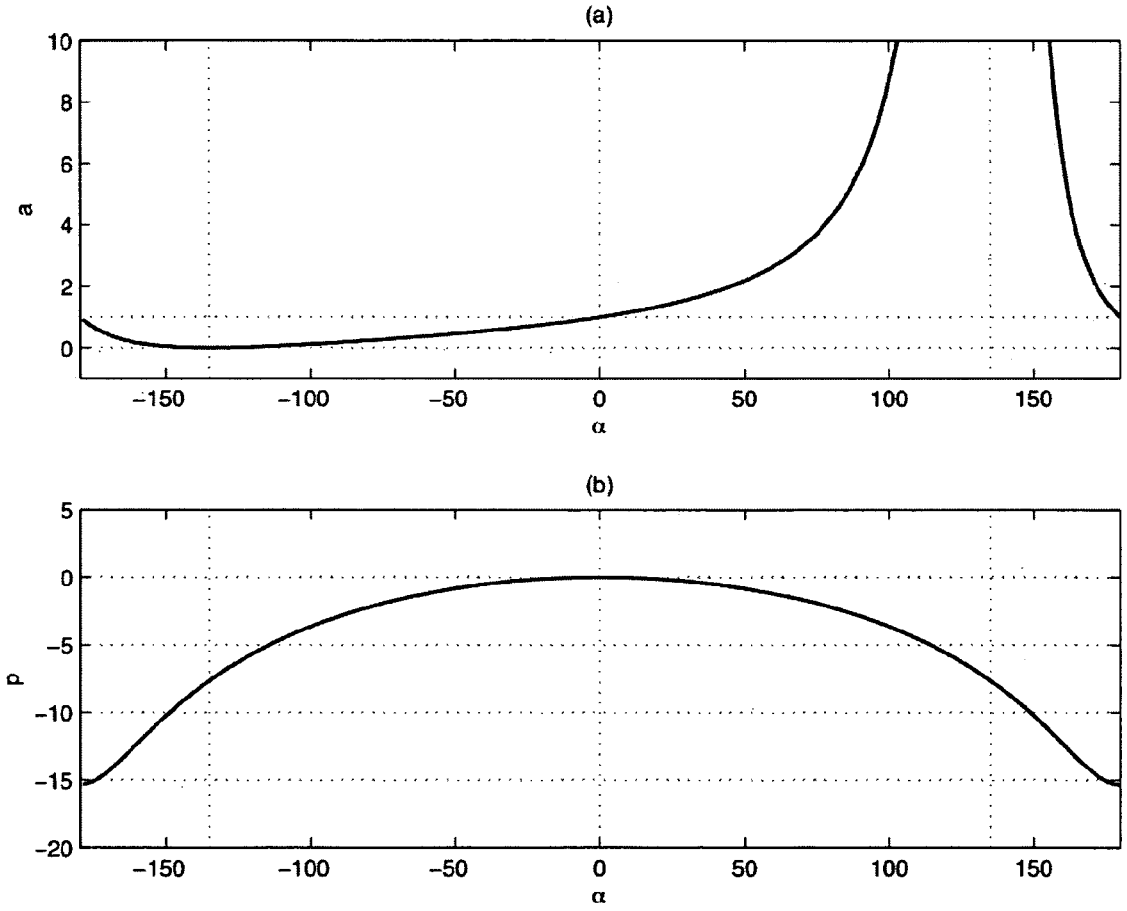

Part (a) of FIG. 4 shows the amplitude ratio as a function of direction of arrival of sound for two coincident cardioid microphones and Part (b) shows the corresponding total response as a function of direction of arrival of sound.

Figure 5:
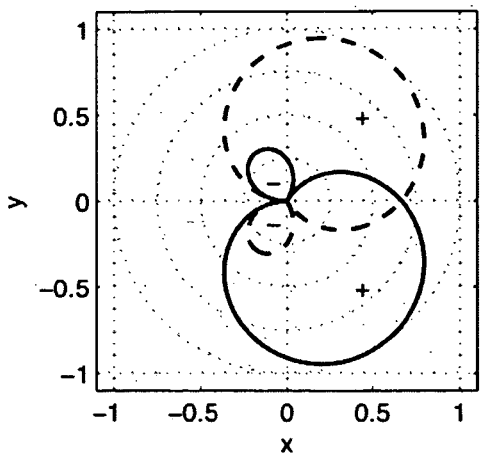

FIG. 5 shows the directional responses of two coincident super-cardioid microphones.

Figure 6:
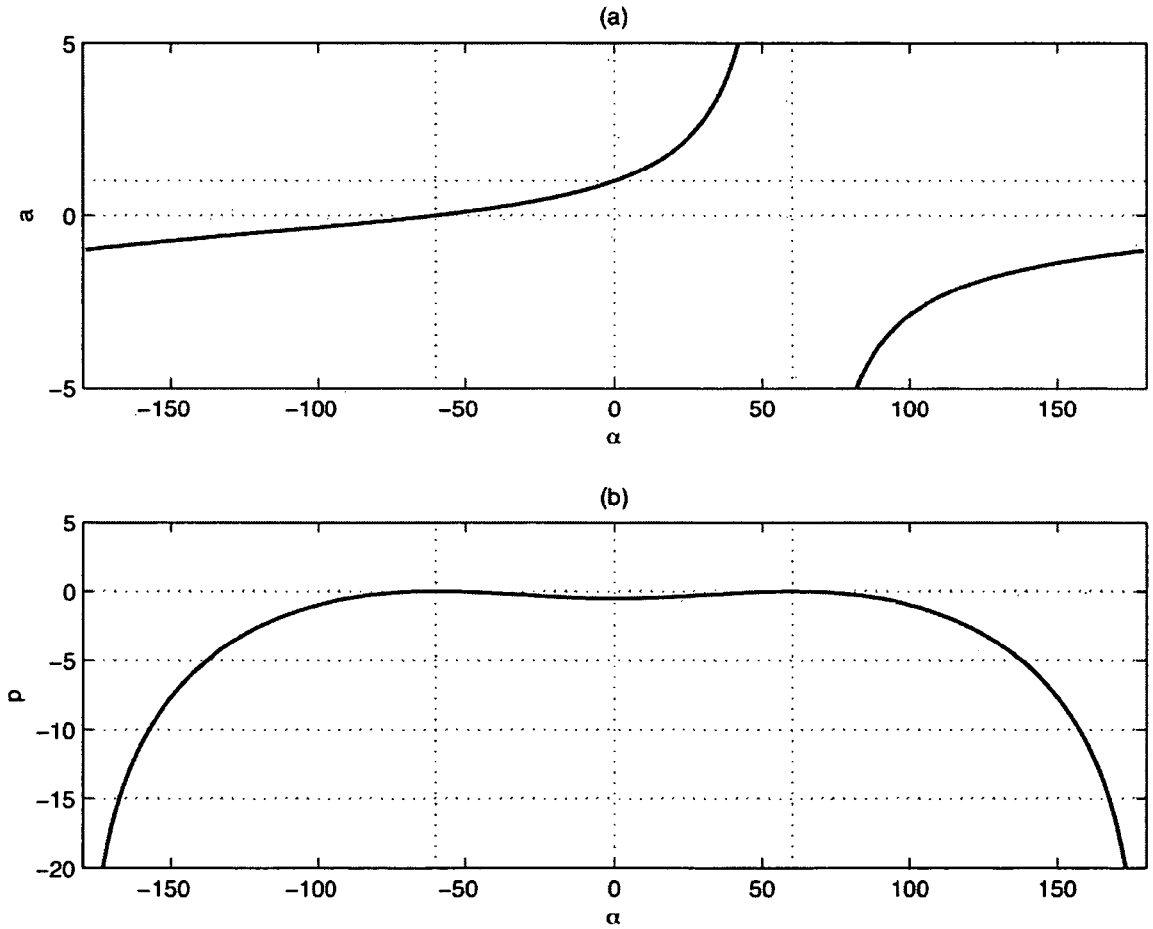

Part (a) of FIG. 6 shows the amplitude ratio as a function of direction of arrival of sound for two coincident super-cardioid microphones and Part (b) shows the corresponding total response as a function of direction of arrival of sound.

Figure 7:
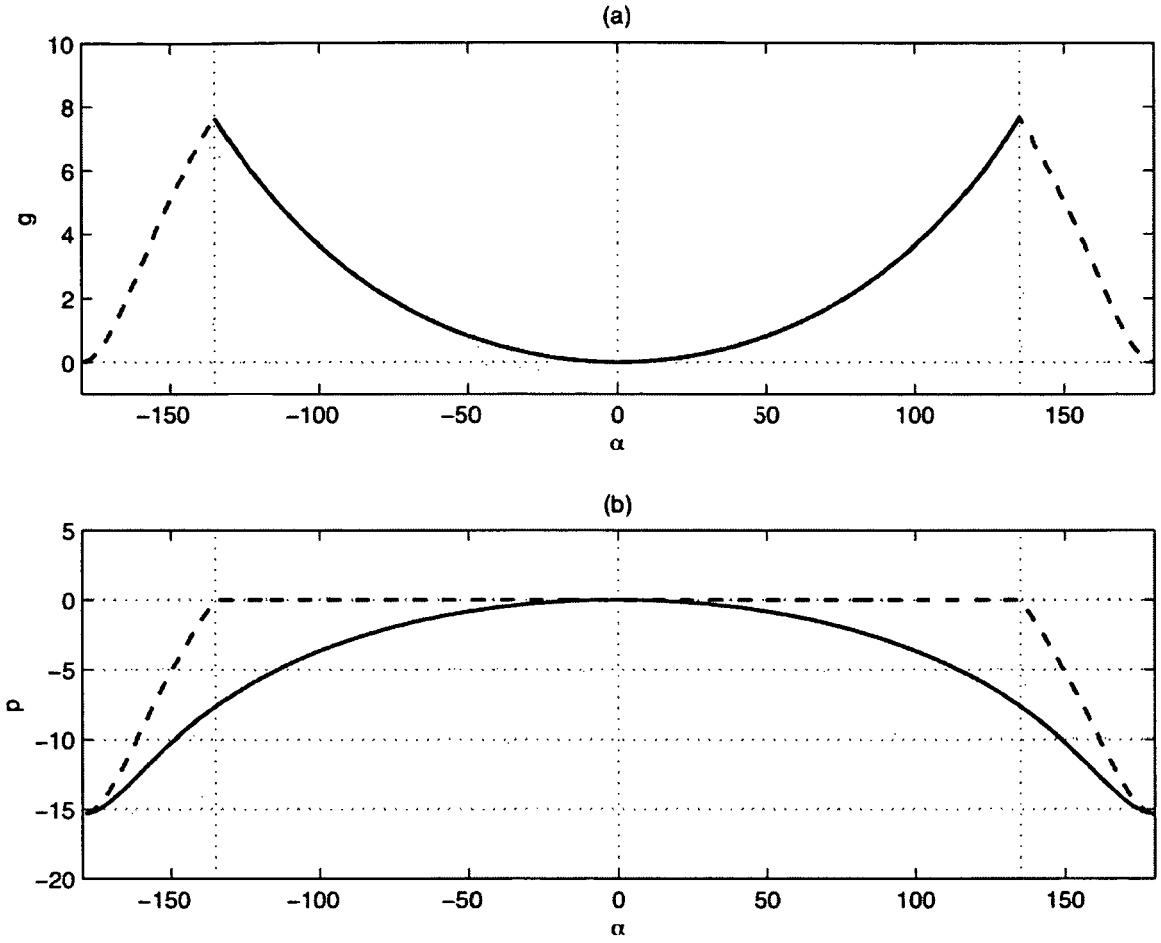

Part (a) of FIG. 7 shows a gain compensation as a function of direction of arrival of sound for two coincident cardioid microphones and Part (b) shows the corresponding total response (dashed) and compensated total response (solid) as a function of direction of arrival of sound.

Figure 8:
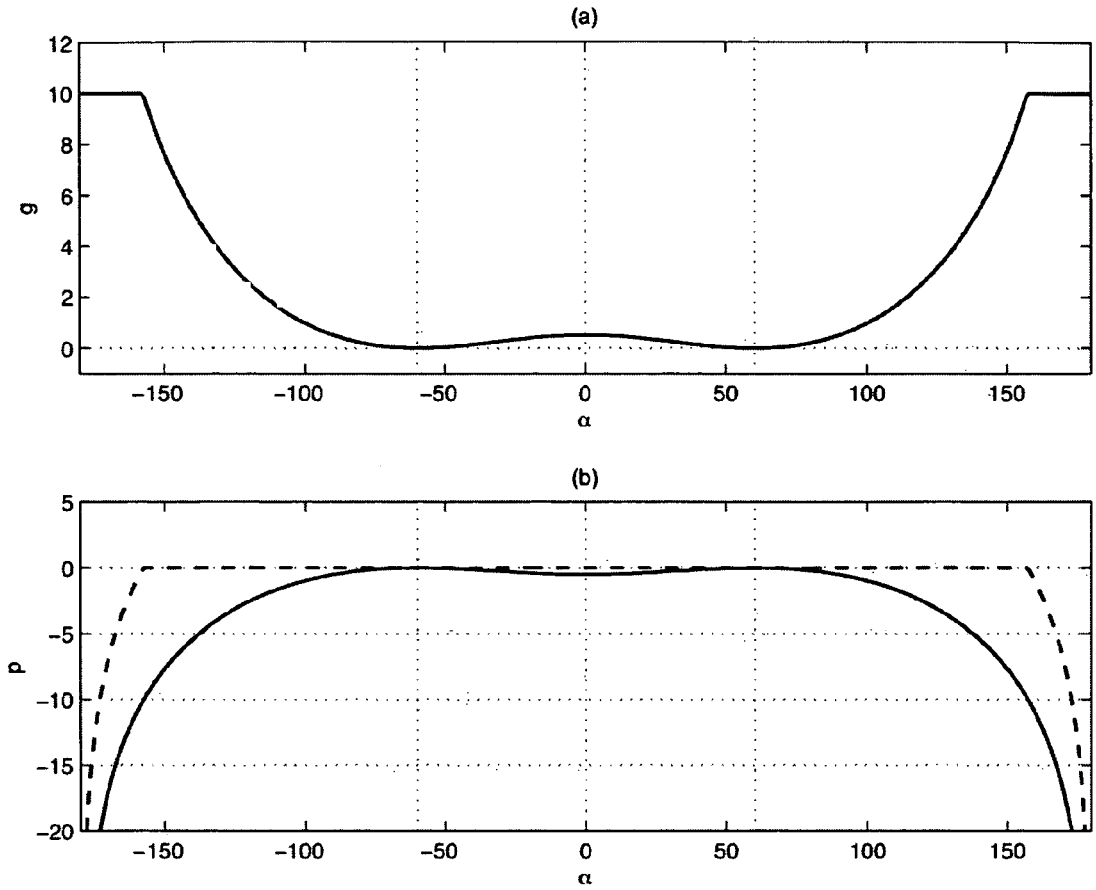

Part (a) of FIG. 8 shows a gain compensation as a function of direction of arrival of sound for two coincident super-cardioid microphones and Part (b) shows the corresponding total response (dashed) and compensated total response (solid) as a function of direction of arrival of sound.

Figure 9:
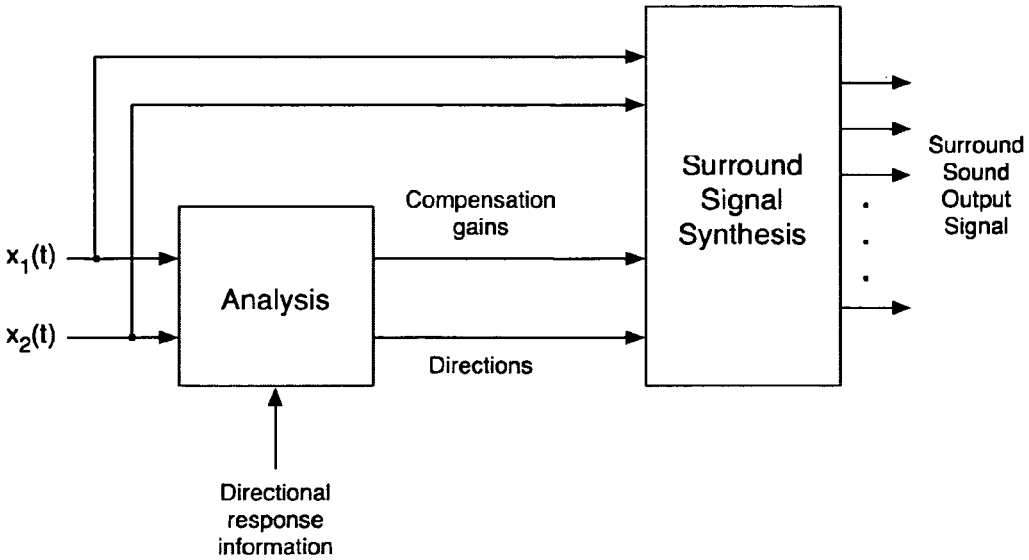

FIG. 9 shows a scheme for generating a surround sound output signal given two microphone generated input signals.

DETAILED DESCRIPTION OF THE INVENTION

I. Introduction

The invention enables the use of a pair of microphones for multi-channel surround recording. A conventional two-channel stereo microphone, or a two-channel microphone specifically optimized for use with the proposed algorithm, is used to generate two signals (or a two-channel or stereo signal). A post-processor is applied to the microphone generated signals to convert them to multi-channel surround. The so-generated surround audio signal mimics the natural spatial aspect of the sound that has arrived at the microphones.

The stereo microphone needs to have directional responses such that the direction of arrival of sound can be estimated from level difference and possibly phase difference between the two microphone generated signals. As will be shown, the range of uniquely decodable directions of arrival can be up to or nearly up to 360 degrees, enabling true multi-channel surround sound.

All the weaknesses of previous techniques mentioned in the introduction are addressed by the invention:

- Since the necessary microphone is based on only two channels, it will be more cost effective to build than a multi-channel microphone.
- The two recorded channels can be stored similarly as storing the signal when using conventional stereo recording.
- The used microphone is coincident or nearly coincident and thus can have a small form factor.
- An additional benefit is that the recorded two signals are a good stereo signal, thus if the post-processing is not applied good stereo performance can be expected.

II. Two-Channel Microphones and their Suitability for Surround Recording

In this section, various two channel microphone configurations are discussed with respect to their suitability for generating a surround sound signal by means of post-processing. Since human source localization largely depends on the direct sound, due to the "law of the first wavefront", the analysis is carried out for a single direct far-field sound arriving from a specific angle $\alpha$ at the microphone in free-field (no reflections). Without loss of generality, for simplicity, we are assuming that the microphones are coincident, i.e. the two microphone capsules are located in the same point. Given these assumptions, the left and right microphone signals can be written as:

$$x_1(t)=r_1(\alpha)s(t)$$

$$x_2(t)=r_2(\alpha)s(t) \tag{1}$$

where s(t) corresponds to the sound pressure at the microphone locations and $r_1(\alpha)$ is the directional response of the left microphone for sound arriving from angle $\alpha$ and $r_2(\alpha)$ is the corresponding response of the right microphone. The signal amplitude ratio between the right and left microphone is $$a(\alpha) = \frac{r_2(\alpha)}{r_1(\alpha)}. \tag{2}$$

Note that the amplitude radio captures the level difference and information whether the signals are "in phase" ($a(\alpha)>0$) or "out of phase" ($a(\alpha)<0$). If a complex signal representation is used, such as a short-time Fourier transform, the phase of $a(\alpha)$ gives information about the phase difference between the signals and information about the delay. This information may be useful if the microphones are not coincident.

Figure 1:
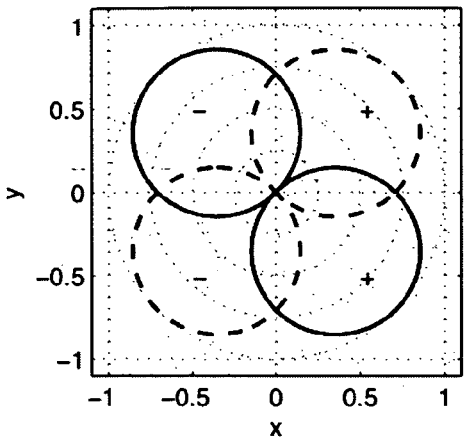
FIG. 1 shows the directional responses of two coincident dipole microphones.

FIG. 1 illustrates the directional responses of two coincident dipole (figure of eight) microphones pointing towards ±45 degrees relative to the forward x-axis. The parts of the responses marked with a + pick up sound with a positive sign and the parts marked with a − pick up sound with a negative sign. The amplitude ratio as a function of direction of arrival of sound is shown in FIG. 2(*a*). Note that the amplitude ratio $a(\alpha)$ is not unique, that is for each amplitude ratio value exist two directions of arrival which could have resulted in that amplitude ratio. If sound arrives only from front directions, i.e. within ±90 degrees relative to the positive x direction in FIG. 1, the amplitude ratio uniquely indicates from where sound arrived. However, for each direction in the front there exists a direction in the rear resulting in the same amplitude ratio. FIG. 2(*b*) shows the total response of the two dipoles in dB, i.e.

$$p(\alpha)=10\log_{10}(r_1^2(\alpha)+r_2^2(\alpha)). \tag{3}$$

Note that the two dipole microphones pick up sound with the same total response from all directions (0 dB).

From the above discussion it is concluded that two dipole microphones with responses as shown in FIG. 1 are not very suitable for surround sound signal generation because of these reasons:

- Only for an angular range of 180 degrees does the amplitude ratio uniquely determine the direction of arrival of sound
- Rear and front sound is picked up with the same total response. There is no rejection of sound from directions outside of the range in which the amplitude ratio is unique.

The next microphone configuration considered are two cardioids pointing towards ±45 degrees with responses as shown in FIG. 3. The result of a similar analysis as previously is shown in FIG. 4. FIG. 4(*a*) shows $a(\alpha)$ as a function of direction of arrival of sound. Note that for directions between −135 degrees and 135 degrees $a(\alpha)$ uniquely determines the direction of arrival of the sound at the microphones. FIG. 4(*b*) shows the total response $p(\alpha)$ as a function of direction of arrival. Note that sound from the front directions is picked up most strongly and more weakly the more sound arrives from the rear.

From this discussion it is concluded that two cardioid microphones with responses as shown in FIG. 3 are suitable for surround sound generation:

- Three quarters of all possible directions of arrivals (270 degrees) can uniquely be determined by means of measuring the amplitude ratio $a(\alpha)$, that is, sound arriving from directions between ±135 degrees.
- Sound arriving from directions which can not uniquely be determined, i.e. from the rear between 135 and 225 degrees, is attenuated, partially mitigating the negative effect of interpreting these sounds as coming from different directions.

A particularly suitable microphone configuration is the use of super-cardioid microphones. The responses of two super-cardioid responses, pointing towards ±60 degrees, are shown in FIG. 5. The amplitude ratio as a function of angle of arrival is shown in FIG. 6(*a*). Note that the amplitude ratio uniquely determines the direction of arrival of sound. This is so, because we have carefully chosen the super-cardioid microphone responses to have a null response at 180 degrees. The other null responses are at directions ±60 degrees.

Note that this microphone configuration picks up sound "in phase" ($a(\alpha)>0$) for front directions in the range ±60 degrees. Rear sound is picked up "out of phase" ($a(\alpha)<0$), i.e. with a different sign. Matrix surround [1-4] uses a similar philosophy for decoding two-channel signals to surround signals. Thus obviously, from this perspective, this microphone configuration is suitable for generating a surround sound signal by means of processing the recorded signals.

FIG. 6(*b*) illustrates the total response of the microphone configuration as a function of direction of arrival. During a quite large directional range, sound is picked up with similar intensity. Towards the rear the total response is decaying until it reaches zero at 180 degrees.

$$\text{The function } \alpha=f(a) \tag{4}$$

yields the direction of arrival of sound as a function of the amplitude ratio between the microphone signals. The function (4) is obtained by inverting the function given in (2) within the desired range in which (2) is invertible.

For the example of two cardioids as shown in FIG. 3, the direction of arrival will be in the range of ±135 degrees. If sound arrives from outside this range, its amplitude ratio will be interpreted wrong and a direction in the range between ±135 degrees will be returned by the function. For the example of two super-cardioids as shown in FIG. 5, the determined direction of arrival can be any value except 180 degrees since both microphones have their null at 180 degrees.

As a function of direction of arrival, the gain of the microphone signals needs to be modified (compensated) in order to pick up sound with the same or approximately the same gain within a desired range of directions. The gain modification (compensation) as a function of direction of arrival is $$g(\alpha)=\min\{-p(\alpha),G\}, \tag{5}$$

where G determines an upper limit in dB for the gain compensation. Such an upper limit is often necessary to prevent that the signals are scaled by too large a factor.

The solid line in FIG. 7(*a*) shows the gain modification within the desired direction of arrival range of ±135 for the case of the two cardioids. The dashed line in FIG. 7(*a*) indicates the gain modification that is applied to sound from rear directions, i.e. between 135 and 225 degrees, where (4) yields a (wrong) front direction. FIG. 7(*b*) shows the total response of the two cardioids (solid) and the total response if the gain compensation is applied (dashed). The limit G in (5) was chosen to be 10 dB, but is not reached as evident from FIG. 7(*a*).

A similar analysis is carried out for the case of the super-cardioid microphone pair. FIG. 8(*a*) shows the gain modification for this case. Note that at the sides of the graph, the limit of G=10 dB is reached. FIG. 8(*b*) shows the total response (solid) and the total response if the gain compensation is applied (dashed). Note that the compensated total response is decreasing towards the rear, despite of compensation. Due to the limitation of the compensation gain, the total response is decreasing towards the rear (due to the nulls at 180 degrees infinite compensation would be required). After compensation, sound is picked up with full level (0 dB) approximately in a range of ±160 degrees, making the super-cardioid microphones in principle a very suitable for recording of signals to be converted to surround sound signals.

III. Converting the Microphone Signals to a Surround Signal

The previous analysis shows that in principle two microphones (or a two-channel microphone, or a stereo microphone) can be used to record signal which contain sufficient information to generate a surround sound audio signal. The invention enables effective usage of two-channel microphones (or stereo microphones, or use two microphone capsules) together with post-processing to generate a surround sound signal. Thus, effectively, the invention enables surround sound recording with a two channel microphone.

Conceptually, two important aspects of the invention are:

Use of knowledge (or assumption) about the directional responses of the microphones to obtain information about the directions to which sound components of the microphone generated input signals are rendered when generating the surround output signal. A sound component is defined as signal part contained in the microphone generated signals.

Additionally, two-channel microphones suitable for surround recording have the property that the more sound arrives from the rear at the microphones, the lower is the level at which sound is picked up. This is due to the directional responses of the microphones, which are weaker towards the rear. Thus, it is also important to consider knowledge (or assumption) about the directional responses of the microphone signals to determine compensations gains, which when applied to sound components, result in that sound components are picked up with the same or approximately the same gain within a desired range of directions.

In the following, two examples are described on how to implement the invention.

III.A Using a Matrix Decoder

One way of converting the microphone signal pair to a multi-channel surround audio signal, is to use a modified matrix surround decoder [1-4]. The matrix surround decoder is modified to render sound components to the correct directions (4) and gain compensation according to (5) needs to be added too.

Note that when super-cardioid microphones are used, gain compensation can be applied to the two microphone generated signals, resulting in a signal which is matrix surround compatible. In this case, the matrix decoder already can use its mechanism for determining rendering direction of sound components, but gain compensation needs to be added to the matrix decoder.

III.B Using an Alternative Decoder

A more sophisticated way of generating the multi-channel surround audio signal is described in the following. Usually, not only a direct wavefront reaches the microphones, but a mix of direct sound and reflections. Thus, the signal model of (1) is extended to:

$$x_1(t)=r_1(\alpha)s(t)+n_1(t)$$

$$x_2(t)=r_2(\alpha)s(t)+n_2(t), \tag{6}$$

where s(t) represents a direct localizable sound and $n_1(t)$ and $n_2(t)$ represent reflected sound or generally speaking sound which is independent between the two microphones. The signal model (6) can be written simpler as $$x_1(t)=s(t)+n_1(t)$$

$$x_2(t)=ws(t)+n_2(t), \tag{7}$$

where now s(t) does not anymore directly relate to the sound pressure of direct sound at the microphone locations, but is a scaled version thereof. The weights w is the amplitude ratio of the direct sound.

In order to improve performance and allow simultaneously sound arriving from different directions at different frequencies, the signal model is preferably considered independently at different frequencies. In this case, (7) and the analysis and synthesis below is considered in a filterbank subband domain or short-time spectral domain.

There are many heuristic methods to obtain estimates of s(t), a, $n_1(t)$, and $n_2(t)$. One possibility is to use:

$$w = \operatorname{sign}(\Phi)\frac{E\{x_2^2(t)\}}{E\{x_1^2(t)\}} \tag{8}$$

$$s(t) = \operatorname{abs}(\Phi)\frac{1}{1+\operatorname{abs}(w)}x_1(t) + \operatorname{abs}(\Phi)\frac{\operatorname{abs}(w)}{1+\operatorname{abs}(w)}x_2(t),$$

$$n_1(t) = (1-\operatorname{abs}(\Phi))x_1(t)$$

$$n_2(t) = (1-\operatorname{abs}(\Phi))x_2(t),$$

where E{.} is a short time average or mean estimate and Φ is a short-time estimate of the normalized cross-correlation:

$$\Phi = \frac{E\{x_1(t)x_2(t)\}}{\sqrt{E\{x_1(t)x_1(t)\}E\{x_2(t)x_2(t)\}}}. \quad (9)$$

The estimated weight w is used as an estimate for the direct sound amplitude ratio a(α) (2). The gain compensated direct sound is $$\begin{aligned}\tilde{s}(t) &= 10^{\frac{g(\alpha)}{20}} s(t) \\ &= 10^{\frac{g(f(w))}{20}} s(t),\end{aligned} \quad (10)$$

where f(w) (4) is the direction estimate of the direct sound. The gain compensated direct sound signal is mixed to the surround sound output signal such that it is perceived from the correct or desired direction by a listener. Multi-channel amplitude panning may be used to achieve this.

One good option is to mix the left reflected sound signal $n_1(t)$ (also denoted ambient sound or reflected sound signal) to the front and rear left channels of the surround output signal. To improve ambience and improve spatial image stability, the signal given to the rear can be delayed and low-pass filtered. We are using a delay of 30 milliseconds and a low-pass filter with 8 kHz cutoff frequency. Similarly, $n_2(t)$ is mixed to the right front and right rear channels of the surround output signal. Alternatively, reverberators may be applied to the reflected sound in the rear surround channels to decorrelate them from the reflected sound in the front surround channels.

It is not obvious whether to apply the gain compensation only to the direct sound (10), or also to the reflected sound $n_1(t)$ and $n_2(t)$. We tried both and it does not seem to make a big difference.

As mentioned, it is favorable to process the signals in a subband or spectral domain. We are using a short-time Fourier transform. To reduce the number of spectral coefficients (or subbands), we are grouping subbands together to "critical bands", with a frequency resolution motivated by the periphery of the human auditory system, in a similar fashion as described in [5]. The proposed processing is applied independently in each "critical band". After processing, the spectral coefficients of the output surround signal are converted back to the time-domain to generate the time-domain surround sound output signals.

IV Implementation

The above described method will be suitably implemented in a device embedding an audio processor such as a DSP. This device comprises different software components dedicated to the various tasks performed. A first component concerns a first calculation means that determine directions of sound components related to the microphone characteristics.

A second component concerns a second calculation means that determine compensation gains of sound components related to the microphone characteristics.

A third component concerns a third calculation means for generating the output audio channels, y1, . . . , yM, by using the microphone generated audio channels, x1, x2, directions, and compensation gains.

It is to be noted that in one embodiment of the invention, the compensation gains of the second calculation means are determined related to the sum of the responses of the microphones.

In case that the calculation is executed in subbands, the device of the invention comprises a splitting means to convert the input signal into a plurality of subbands and the first, second, and third calculation means are acting on each subband as a function of time.

The contents of the following publications are hereby incorporated by reference in their entirety, [1] J. Hull, "Surround sound past, present, and future," Tech. Rep., Dolby Laboratories, 1999, www.dolby.com/tech/, [2] J. M. Eargle, "Multichannel stereo matrix systems: An overview," IEEE Trans. on Speech and Audio Proc., vol. 19, no. 7, pp. 552-559, July 1971, [3] R. Dressler, "Dolby Surround Prologic II Decoder-Principles of operation," Tech. Rep., Dolby Laboratories, 2000, www.dolby.com/tech/, [4] K. Gundry, "A new active matrix decoder for surround sound," in Proc. AES 19th Int. Conf., June 2001, and [5] C. Faller and F. Baumgarte, "Binaural Cue Coding—Part II: Schemes and applications," IEEE Trans. on Speech and Audio Proc., vol. 11, no. 6, pp. 520-531, November 2003.

The invention claimed is:

1. Method to generate multiple output audio channels (y1, . . . yM) from two microphone generated audio channels (x1, x2), in which the number of output channels is equal or higher than two, the method comprising:

determining, using a device embedding a processor, directions of sound components related to microphone characteristics;

determining, using the device embedding a processor, compensation gains of sound components related to the microphone characteristics such that upon application of the compensation gains to sound components, sound components are picked up with one of a same gain and approximately the same gain within a desired range of directions; and generating, using the device embedding the processor, the output audio channels, y1, . . . , yM, wherein a gain of the microphone generated audio channels is modified as a function of direction of arrival according to the compensation gains.

2. Method of claim 1, wherein the determining of the directions of sound components includes determining the directions of sound components as a function of amplitude ratios of the microphone generated signals.

3. Method of claim 1, wherein the determining of the directions of sound components includes determining the directions of sound components as a function of phase relations between the microphone generated signals.

4. Method of claim 1, wherein the determining of the compensation gains includes determining the compensation gains in relation to a sum of responses of the microphones.

5. Method of claim 1, wherein the output audio channels are a surround sound audio signal.

6. Method of claim 1, wherein the generating of the output audio channels includes using a matrix decoder.

7. Method of claim 1, further comprising:

decomposing the microphone generated audio channels into direct sound, ambient sound, and a measure related to direction of direct sound.

8. Method of claim 1, wherein processing is carried out in a plurality of subbands, and the directions of sound components and compensation gains are estimated in each subband as a function of time.

9. Method of claim 1, wherein the determining of the compensation gains includes determining the compensation gains based on one of knowledge and an assumption about directional responses of the microphone generated audio channels.

10. Method of claim 1, further comprising:

applying the compensation gains to sound components.

11. Device to generate multiple output audio channels (y1, . . . , yM) from two microphone generated audio channels (x1, x2), in which the number of output channels is equal or higher than two, wherein the device is configured to determine directions of sound components related to microphone characteristics;

the device is configured to determine compensation gains of sound components related to the microphone characteristics such that, upon application of the compensation gains to sound components, sound components are picked up with one of a same gain and approximately the same gain within a desired range of directions; and the device is configured to modify a gain of the microphone generated audio channels as a function of direction of arrival according to the compensation gains, to generate the output audio channels, y1, . . . , yM.

12. Device of claim 11, wherein the device is configured to determine the directions of sound components as a function of amplitude ratios of the microphone generated signals.

13. Device a claim 11, wherein the device is configured to determine the directions of sound components as a function of phase relations between the microphone generated signals.

14. Device of claim 11, wherein the device is configured to determine the compensation gains in relation to a sum of responses of microphones.

15. Device of claim 11, wherein the device is configured to convert the microphone generated signals into a plurality of subbands, and the device is configured to act on each subband as a function of time.

16. Device of claim 11, wherein the device is configured to determine the compensation gains considering one of knowledge and an assumption about directional responses of the microphone generated audio channels.

17. Device of claim 11, wherein the device further comprises:

a pair of microphones to provide the microphone-generated audio channels (x1, x2), wherein the microphones are dipole microphones pointing towards different directions.

18. Device of claim 11, wherein the device further comprises:

a pair of microphones configured to provide the microphone-generated audio channels, wherein the microphones are cardioid microphones pointing towards different directions.

19. Device of claim 11, wherein the device further comprises:

a pair of microphones configured to provide the microphone-generated audio channels, wherein the microphones are super-cardioid microphones pointing towards different directions.

20. Device of claim 11, wherein the device is configured to apply the compensation gains to the sound components.

* * * * *